US005505393A

United States Patent [19]

Serban et al.

[11] Patent Number: 5,505,393

[45] Date of Patent: Apr. 9, 1996

[54] CRUSHING DEVICE ESPECIALLY FOR SCRAP METAL

[75] Inventors: Petre Serban, Kassel; Siegmar Schäfer, Freiberg; Josef Weber, Melsungen, all of Germany

[73] Assignee: Thyssen Industrie AG, Essen, Germany

[21] Appl. No.: 249,794

[22] Filed: May 25, 1994

[30] Foreign Application Priority Data

May 25, 1993 [DE] Germany ..... 43 17 287.3

[51] Int. Cl.[6] ..... B02C 13/282; B02C 13/04

[52] U.S. Cl. ..... 241/86.1; 241/86.2; 241/88.2; 241/189.1; 241/288; 241/289

[58] Field of Search ..... 241/73, 82, 86, 241/86.1, 86.2, 88.4, 88.2, 186.2, 186.4, 189.1, 193, 237, 239, 242, 243, 287, 288, 289

[56] References Cited

U.S. PATENT DOCUMENTS

| | | | |
|---|---|---|---|
| 12,659 | 6/1907 | Williams | 241/189.1 X |
| 1,322,546 | 11/1919 | Davidson | 241/189.1 X |
| 1,647,730 | 11/1927 | Hartman | 241/82 |
| 1,803,585 | 5/1931 | Battey | 241/237 X |
| 2,045,687 | 6/1936 | Armstrong | 241/239 X |
| 2,305,159 | 12/1942 | Heckman et al. | 241/82 X |
| 2,375,370 | 5/1945 | Krider | 241/289 |
| 3,343,800 | 9/1967 | Rasmussen | 241/189.1 X |
| 3,627,212 | 12/1971 | Stanton | 241/73 |
| 5,044,567 | 9/1991 | Hte et al. | 241/189.1 X |

FOREIGN PATENT DOCUMENTS

| | | | |
|---|---|---|---|
| 2306742 | 11/1976 | France | 241/189.1 |
| 372154 | 3/1923 | Germany | 241/289 |
| 3235163 | 3/1984 | Germany | 241/189.1 |
| 3643529 | 3/1988 | Germany . | |
| 3905682 | 8/1990 | Germany . | |
| 4016295 | 11/1991 | Germany . | |
| 2209962 | 6/1989 | United Kingdom . | |

*Primary Examiner*—Timothy V. Eley
*Attorney, Agent, or Firm*—Robert W. Becker & Associates

[57] ABSTRACT

A crushing device for crushing material such as scrap metal and refuse has a housing with a material feeding section and a material removal section for removing crushed material. A shaft with a rotor connected thereto is rotatably supported in the housing. The rotor comprises crushing members. The housing has abutments for cooperating with the crushing members. The feeding section is positioned below a horizontal plane in which the shaft is positioned. An outlet is positioned, when viewed in the rotational direction of the rotor, directly adjacent to and lower than the material feeding section for at least partially replacing the removal section.

6 Claims, 3 Drawing Sheets

CRUSHING DEVICE ESPECIALLY FOR SCRAP METAL

BACKGROUND OF THE INVENTION

The present invention relates to a crushing device especially for scrap metal and industrial and/or domestic refuse, having a housing with a material feeding section and a material removal section. The housing contains a rotor that is rotatable about a horizontal shaft positioned in the housing and is provided with crushing members whereby the crushing members for performing the crushing operation cooperate with abutments provided at the housing.

Such a crushing device, for example, is known from German Patent 36 43 529 in which the material to be crushed is subjected over an angular distance of approximately 180° to a direct crushing operation and is subsequently guided to a material removal outlet of variable size. When the material to be crushed presents a great resistance to the crushing operation, there is a risk that until the material to be crushed reaches the material removal outlet, where the non-crushable or difficult-to-crush material can be rejected, the material subjects the rotor and the housing, respectively, its abutments to considerable forces. Due to the resulting forces damage especially to the rotor cannot be avoided. The resulting unfavorable change of the dynamic performance of the rotor in extreme situation can lead to breakdown of the entire crushing device.

It is therefore an object of the present invention to improve a crushing device of the aforementioned kind such that peak values of the forces generated during the crushing process, which peak values greatly surpass the average forces required and which during permanent operation would result in an overload of the device, can be suppressed.

SUMMARY OF THE INVENTION

The crushing device for crushing material, especially scrap metal and industrial and/or domestic refuse, according to the present invention is primarily characterized by:

A housing with a material feeding section and a material removal section for removing crushed materials;

A shaft rotatably supported in the housing;

A rotor connected to the shaft;

The rotor comprising crushing members;

The housing having abutments for cooperating with the crushing members;

Wherein the feeding section is positioned below a horizontal plane in which the shaft is positioned;

An outlet positioned, when viewed in the rotational direction of the rotor, adjacent to and lower than the material feeding section for at least partially taking over the removal function of the removal section.

Preferably, the outlet has a wall comprised of multiple wall sections, the wall defining the outlet cross-section, and wherein the outlet cross-section is adjustable by displacing one of the wall sections relative to the other wall sections. Preferably, the device further comprises prestressed elastic elements, wherein the one wall section is adjustable against the force of the prestressed elastic elements.

Advantageously, the one wall section that is adjustable is a bottom plate that is pivotable about a horizontal axis.

In another embodiment of the present invention, the one wall section has ribs arranged in a direction of feeding of the material. Preferably, the height of the ribs increases in the direction of feeding of the material. Advantageously, the ribs are arranged over a width of the rotor such that upon displacement of the one wall section toward the rotor the ribs engage free space provided between the crushing members.

Preferably, the crushing device further comprises an abutment designed to be loaded by pulling and positioned within the material feeding section for cooperating with the crushing members of the rotor to crush the material.

In a preferred embodiment of the present invention, the material feeding section comprises a material supporting piece and an abutment, wherein the material supporting piece, the abutment and the outlet form a rigid unit and wherein a distance of the rigid unit to the rotor is adjustable. Preferably, the abutment is designed to be loaded by pressure.

According to the present invention, the material feeding section is positioned below the horizontal plane in which the shaft of the rotor is positioned and in the direction of rotation of the rotor an outlet is provided adjacent to the material feeding section which at least partially takes over the removal function of the material removal section and which is positioned lower than the material feeding section.

An outlet which is arranged directly adjacent to the material feeding section is advantageous in two respects. On the one hand, the material that presents an especially great resistance to being crushed, can be identified based on the size of the reaction forces upon impact of the crushing members on the material and can therefore be immediately removed from the crushing process. On the other hand, it is possible to remove the entire amount of material after having been crushed only within the area between the material feeding section and the outlet and to thereby avoid further crushing within the device. Such an operational mode for easily crushable materials delivers a product which is immediately available for further use without being subjected to a further crushing operation. Materials that are more difficult to crush can thus be subjected to a precrushing process, and further crushing can be performed preferably in a mill or a shredder of conventional design.

For changing or adjusting the effective outlet cross-section, the outlet in a preferred embodiment of the invention is provided with a wall that is comprised of multiple wall sections at least one of which is adjustable relative to the others.

According to an expedient embodiment of the invention the displacement of one of the wall sections relative to the other wall sections is carried out against the force of prestressed elastic elements. When the forces generated during crushing surpass a certain preselected value, the wall section that is adjustable will give and thus free a greater cross-section for the material that cannot be crushed sufficiently.

Expediently, the displaceable wall section is in the form of a pivotable bottom plate the horizontal pivoting axis of which is positioned on the side of the bottom plate adjacent to the material feeding section.

When the displaceable wall section is provided with ribs extending in the direction of feeding of the material, the height of which preferably increases in the direction of feeding, respectively, in the direction of removal of the crushed material, sufficiently crushed material can be removed between the ribs.

The larger pieces of material transported on the upper edges of the ribs remain within the crushing process, if a further crushing of this material is desired. For this purpose, the ends of the ribs are positioned at least at the level of the housing part arranged downstream within the crushing process. When a further crushing of the material is not desired, the displaceable wall section is displaced downwardly such that between the ends of the ribs and the part of the housing arranged downstream a free space of a sufficient size is produced so that the larger pieces of material can be removed separate from the crushed material between the ribs.

For an intensive crushing of especially easily crushable material, in a preferred embodiment of the present invention the ribs on the displaceable wall section are arranged when viewed in a direction transverse to the material feeding direction, i.e., over the width of the device, such that the ribs upon displacement of the wall section toward the rotor are immersed into the free spaces between the crushing members of the rotor. The areas of the ribs which during this displacement remain within the outlet may be provided with additional structural elements, for example, in the form of longitudinal or transverse stays, for determining the size and throughput of material.

According to another embodiment of the invention an abutment is provided within the material feeding section which is essentially to be loaded by pulling forces. The abutment cooperates with the crushing members of the rotor during the crushing process of the material. By providing such an abutment it is possible to loosen material conglomerates in order to separate them and to partially crush them. A further crushing can be performed in the same crushing device or in another crushing device which is designed to meet special crushing specifications.

In another preferred embodiment of the crushing device the material feeding section is provided with a material-supporting end piece and an abutment. The abutment and the end piece together with the outlet form a rigid unit having an adjustable distance to the rotor.

The abutment is expediently to be loaded by pressure. When within the area of the abutment forces occur that are too great, the distance between the abutment and the rotor is increased so that at the same time the cross-section of the outlet is enlarged. Material that is difficult to crush can thus be removed from the crushing device without problems and without causing an undue loading of the crushing device.

BRIEF DESCRIPTION OF THE DRAWINGS

The objects and advantages of the present invention will appear more clearly from the following specification in conjunction with the accompanying drawing, in which.

DESCRIPTION OF PREFERRED EMBODIMENTS

The present invention will now be described in detail with the aid of several specific embodiments utilizing FIGS. 1 to 3.

Figure 1:
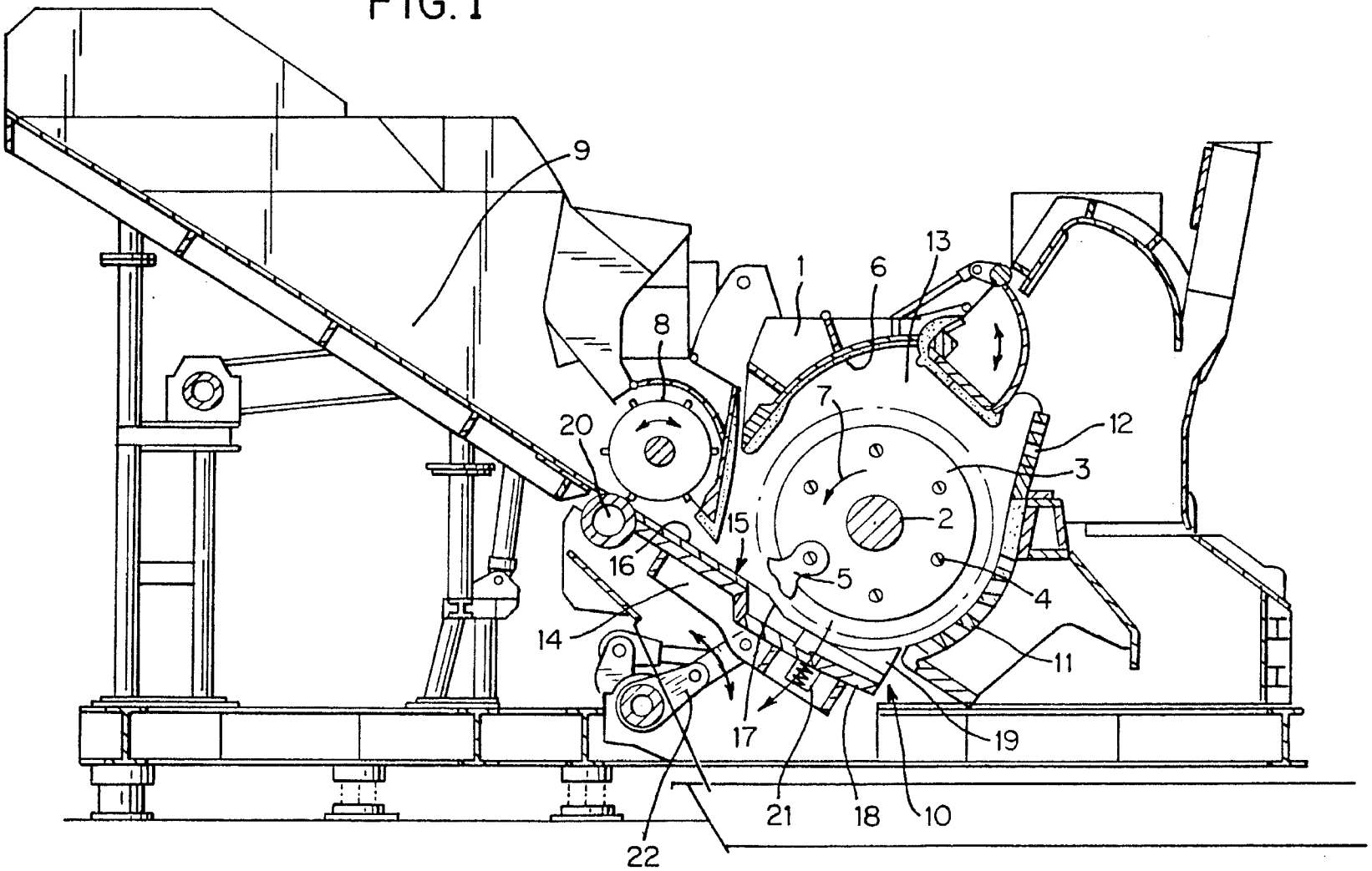
FIG. 1 shows a vertical section of a crushing device with outlet in a first operational position in which during normal operation material of a predetermined size and, upon overload, also coarse material is removed.
Figure 2:
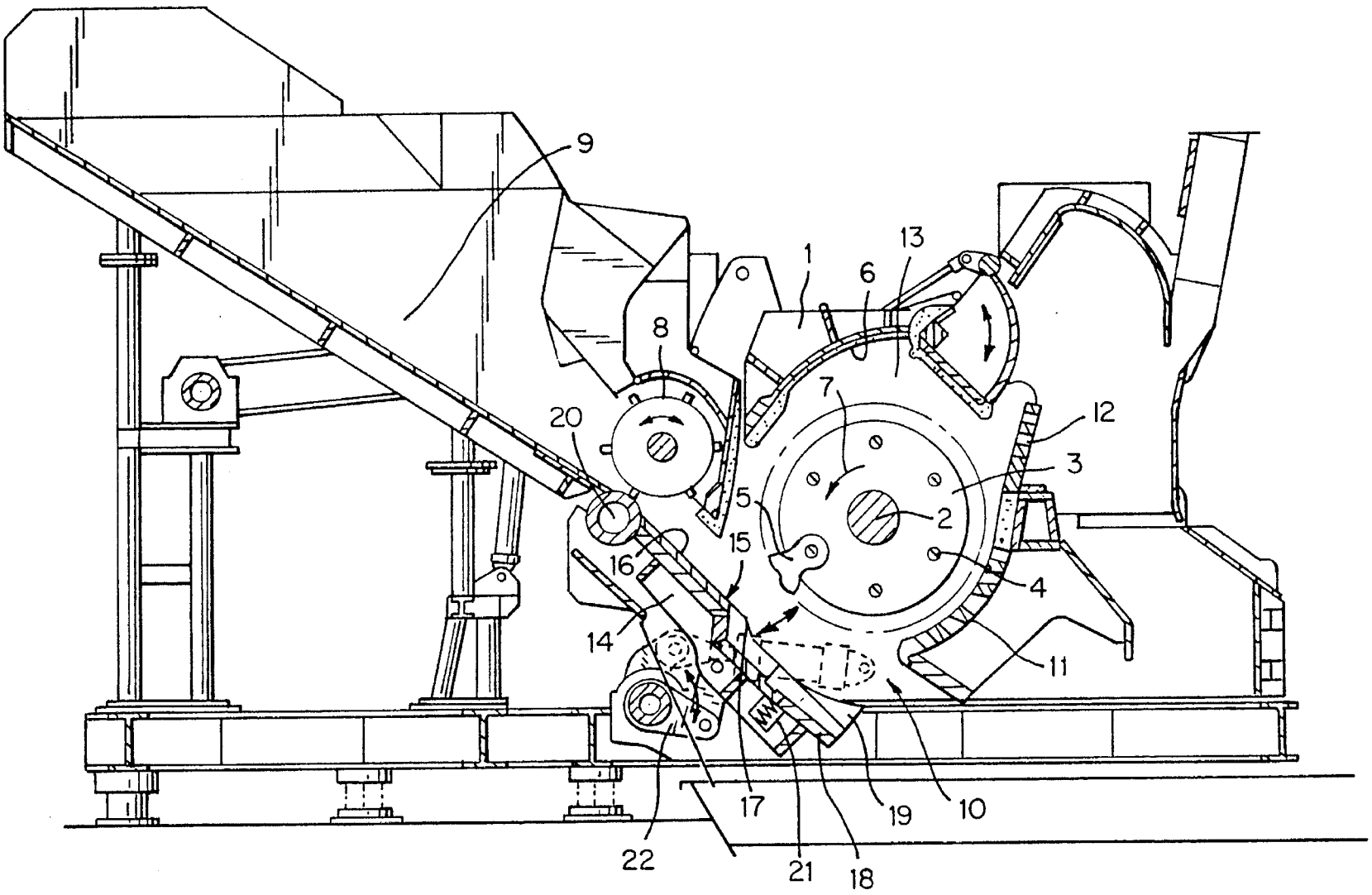
FIG. 2 shows a vertical section of the crushing device with outlet in a second operational position in which coarse material is constantly removed but separate from material of a smaller size.
Figure 3:
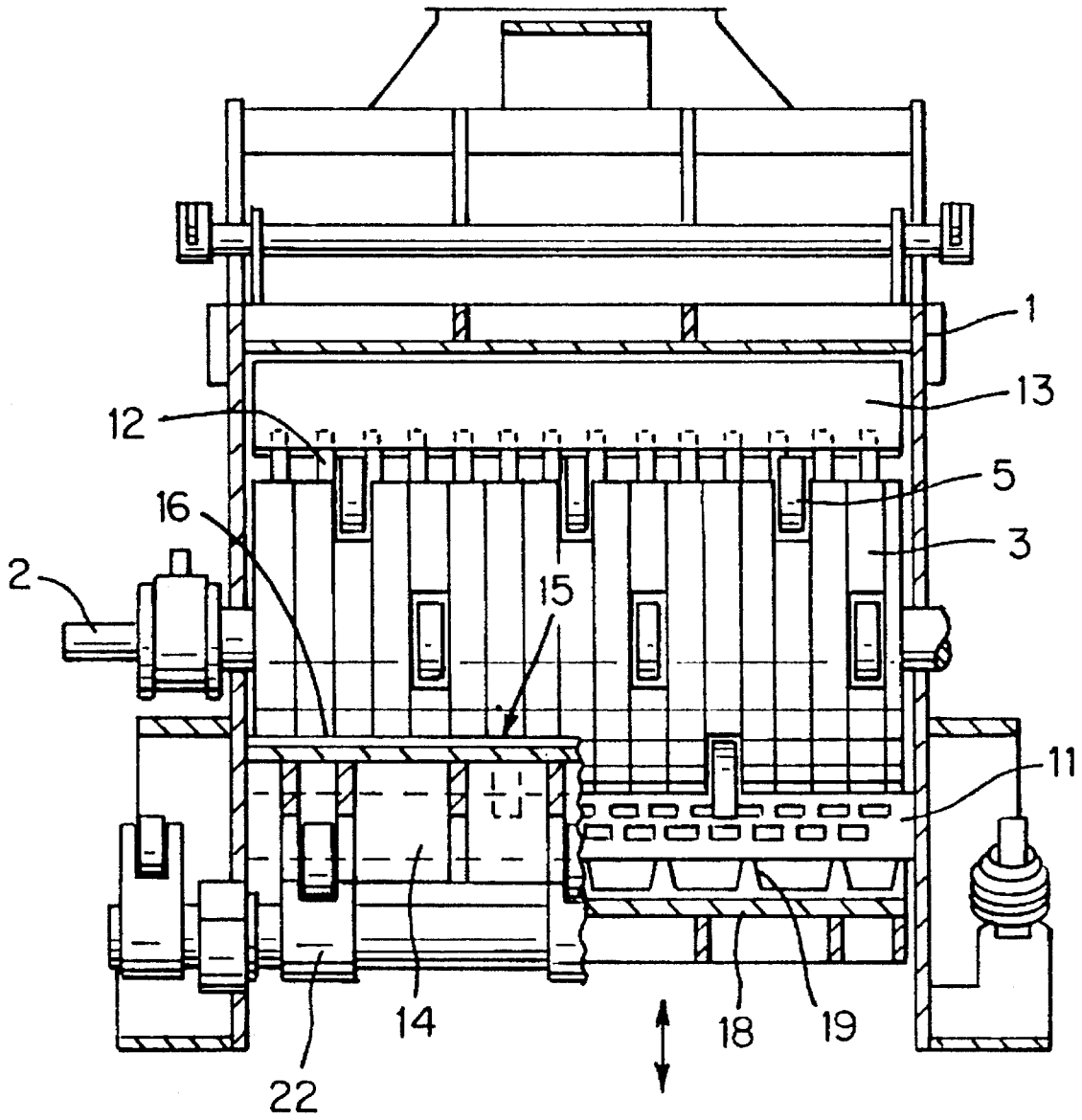
FIG. 3 shows a front view of the crushing device, partially in section.

FIGS. 1, 2, and 3 show a housing 1 of a hammer crusher with a rotor 3 that is supported on a horizontal shaft 2. About the periphery of the rotor 3 pivotable crushing members (hammers) 5 are arranged that are pivotable about the horizontal axes 4. These crushing members 5 cooperate with the inner surfaces 6 of the housing 1 surrounding the rotor 3 when the rotor 3 is rotated in directions of arrow 7 and is supplied via the metering device 8 with material to be crushed, such as car bodies, steel containers etc. The inner surfaces 6 of the housing 1 form, starting at the material feeding section 9, in the rotational direction of the rotor 3 substantially an outlet 10, a grate section 11, a material removal section 12, and a deflecting channel 13.

The outlet 10 is comprised of a base frame 14 and a material transport surface 15 which is comprised of a guiding surface 16, an impact edge 17, and a bottom 18 with a plurality of ribs 19 extending parallel to one another in the direction of feeding of the material. The height of the ribs 19 in the direction of rotation of the rotor 3 increases so that in the operational state represented in FIG. 1 a continuous transition from the outlet 10 to the grate section 11 is provided.

The base frame 14 and the material transport surface 15 are pivotable about a common horizontally arranged axis 20 whereby the material transport surface 15 can be moved in the direction of the base frame 14 counter to the force of elastic elements in the form of a spring package 21 supported at the base frame 14 upon surpassing the prestress. For displacement of the base frame 14 an adjusting device 22 is provided at the housing 1.

During operation of the hammer crusher the material is transported from the material feeding section 9 via the metering device 8 onto the guiding surface 16 where preferably in connection with the impact edge 17 the crushing process takes place such that the rotating hammers 5 act on the material. Easily crushable material and material which has been fed into the device in smaller pieces passes through the free spaces between the ribs 19 and is removed through the outlet 10. The other material remains within the crushing process until reaching the removal section 12 the outlet opening of which is expediently smaller than the outlet cross-section of the outlet 10. Material pieces which within the area of the material removal section 12 have not been sufficiently crushed will all exit the interior of the crushing device after completing a pass through the rotor housing via the outlet 10.

When large pieces and difficult-to-crush material coming from the material feeding section 9 reach the material transport surface 15, the material transport surface 15 is displaced when the prestress of the spring package 21 is surpassed so that the distance to the rotor 3 is enlarged. Above the ribs 19, as can be seen in FIG. 2, material pieces that still present too great a resistance to the crushing process can be removed from the further crushing operation without having been placed between the hammers 5 and the rigid abutments. Excessively high loads of the hammer crusher by forces that, compared to normal operation, are considerably greater is therefore prevented.

Depending on the type of material to be crushed, the material removal section 12 may be obsolete. It is also possible to provide further outlets with differently sized cross-sections.

In the context of the present invention it is also suggested to not provide the bottom 18 with ribs 19, especially when the hammer crusher is used as a pre-crushing device without specific predetermined size specifications with respect to the desired particle size. In such a situation it is furthermore possible to arrange the guiding surface 16 rigidly at the housing.

The present invention further includes an embodiment according to which an arrestable metering device 8 can be used as an abutment whereby the impact edge 17 is no longer needed when a loosening and pulling-apart of the material seems required in order to prepare it for further crushing. With such a crushing operation the tangential forces of the crushing members or hammers 5 are being used.

The present invention is, of course, in no way restricted to the specific disclosure of the specification and drawings, but also encompasses any modifications within the scope of the appended claims.

What we claim is:

1. A crushing device for crushing material comprising:

a housing with a material feeding section and a removal section for removing crushed material;

a shaft rotatably supported in said housing;

a rotor connected to said shaft;

said rotor comprising crushing members;

said housing having abutments for cooperating with said crushing members;

wherein said material feeding section is positioned below a horizontal plane in which said shaft is positioned;

an outlet positioned, when viewed in the rotational direction of said rotor, adjacent to and lower than said material feeding section for at least partially taking over the removal function of said removal section, wherein said outlet has a wall comprised of multiple wall sections, said wall defining an outlet cross-section, and wherein said outlet cross-section is adjustable by displacing one of said wall sections relative to the other said wall sections;

wherein said one wall section is a bottom plate that is pivotable about a horizontal axis;

wherein said bottom plate has ribs extending in a direction of feeding of the material parallel to one another, wherein between said ribs free spaces are formed; and wherein said ribs each have a height increasing in the direction of feeding of the material such that a top surface of said ribs, during operation of said crushing device, forms a continuous transition into an adjacent housing wall of said housing and that said free spaces between said ribs provide a path for removal of crushed material from said housing.

2. A crushing device according to claim 1, further comprising prestressed elastic elements, wherein said bottom plate is adjustable against the force of said prestressed elastic elements.

3. A crushing device according to claim 1, wherein said ribs are distributed over a width of said bottom plate matching a width of said rotor such that upon displacement of said bottom plate toward said rotor said ribs engage free space provided between said crushing members.

4. A crushing device according to claim 1, further comprising an abutment loadable by pulling forces and positioned within said material feeding section for cooperating with said crushing members of said rotor to crush the material.

5. A crushing device according to claim 1, wherein said material feeding section comprises a material supporting piece and an abutment, wherein said material supporting piece, said abutment, and said outlet form a rigid unit and wherein a distance of said rigid unit to said rotor is adjustable.

6. A crushing device according to claim 5, wherein said abutment is designed to be loaded by pressure.

* * * * *